United States Patent [19]

Kurosawa et al.

[11] Patent Number: 4,879,947

[45] Date of Patent: Nov. 14, 1989

[54] PRINTHEAD WHICH MINIMIZES STRAY MAGNETIC FLUX

[75] Inventors: Makoto Kurosawa; Kenichi Igarashi, both of Ibaragi, Japan

[73] Assignee: Hitachi Koki Co., Ltd., Tokyo, Japan

[21] Appl. No.: 120,724

[22] Filed: Nov. 16, 1987

Related U.S. Application Data

[63] Continuation of Ser. No. 461,361, Jan. 27, 1983, abandoned.

[51] Int. Cl.[4] ..... B41J 3/10

[52] U.S. Cl. ..... 101/93.04; 101/93.29; 400/121; 400/157.2

[58] Field of Search ..... 101/93.04, 93.05, 93.29, 101/93.48; 400/121, 124, 157.2

[56] References Cited

U.S. PATENT DOCUMENTS

| | | | |
|---|---|---|---|
| 3,941,051 | 3/1976 | Barrus et al. | 101/93.04 |
| 4,033,444 | 7/1977 | Beery | 101/93.05 |
| 4,044,668 | 8/1977 | Barrus et al. | 101/93.04 |
| 4,280,404 | 7/1981 | Barrus et al. | 101/93.03 |
| 4,386,563 | 6/1983 | Farb | 101/93.09 |
| 4,513,661 | 4/1985 | Melissa et al. | 400/121 |

*Primary Examiner*—David A. Wiecking

*Attorney, Agent, or Firm*—Sughrue, Mion, Zinn, Macpeak & Seas

[57] ABSTRACT

A dot matrix type printer head in which delays in the release of print hammers are eliminated by providing release coils only in alternate hammer positions, or alternatively, activating at one time only release coils in one of even-numbered and odd-numbered hammer positions. A rear yoke and a permanent magnet affixed to a lower leg of the rear yoke are provided in common for all hammer positions. An upper leg of the rear yoke is divided into a plurality of pole pieces. Hammer elements are provided having lower ends rigidly affixed to the rear yoke at positions adjacent the permanent magnet and upper ends retractable against pole faces of corresponding pole pieces by the magnetic force of the permanent magnet. In a first preferred embodiment of the invention, release coils are provided around only even-numbered or odd-numbered pole pieces. In a second preferred embodiment, release coils are provided around all pole pieces, but only release coils in even-numbered or odd-numbered hammer positions are driven simultaneously. In either case, stray magnetic flux which causes a delay in the release of a print hammer interposed between two previously activated print hammers is eliminated.

7 Claims, 1 Drawing Sheet

PRINTHEAD WHICH MINIMIZES STRAY MAGNETIC FLUX

This is a Continuation, of application Ser. No. 461,361, filed Jan. 23, 1983, now abandoned.

BACKGROUND OF THE INVENTION

The present invention relates to a printer of a type in which a hammer bank having a plurality of spring steel print hammers, each of which is provided with a print pin at one end thereof, is reciprocated along a printing line while the hammers are selectively activated to effect printing. Each of the print hammers is rigidly supported at one end. In its non-printing state, the other end, that is, the end bearing the print pin, is held in a retracted position by the magnetic force of a permanent magnet. To release the print hammer to cause it to be propelled toward the recording medium under its own spring force to thus print a dot, a release coil is activated which produces a magnetic field which opposes that of the permanent magnet. An example of such a printer system is described in U.S. Pat. No. 3,941,051 to Barrus et al. and illustrated in FIG. 1.

As shown in FIG. 1, a print hammer unit of the prior art dot matrix printer includes a leaf spring 5 to the front surface of which are fixed a print pin 6 and a plunger 7 made of a magnetic material. Together, the leaf spring 5, pin 6 and plunger 7 constitute a print hammer. The print hammer unit further includes a permanent magnet 1, a front yoke 2, a rear yoke 3 and an electromagnetic coil 4. The electromagnetic coil 4 is wound around an upper leg portion of the rear yoke 3, that is, a pole portion 30. The lower end of the leaf spring 5 is fixed to a spacer 8 provided at the front of the permanent magnet 1 by means of a screw 9 which passes through the front yoke 2. Reference numeral 10 denotes a screw which fixes the leaf spring 5 to the spacer 8. A slot is formed in the upper end of the front yoke 2 through which the print pin 6 and the plunger 7 pass.

When the coil 4 is not energized, the upper end of the print hammer, including the print pin 6, is retracted against the pole portion 30 due to the magnetic force of the permanent magnet 1. In this position, the leaf spring 5 is elastically deformed. When the electromagnetic coil 4 is energized, the magnetic force generated by the permanent magnet is opposed and effectively cancelled, thereby releasing the leaf spring 5 and permitting it to be propelled by its own spring force toward the printing position and hence causing the print pin 6 to strike against a platen (not shown) through a printing paper and an ink ribbon (not shown). A dot is printed on the printing paper in this manner.

In the complete hammer bank (printer head), the permanent magnet 1, the yokes 2 and 3, etc. extend along substantially the whole printing line. The hammer bank is reciprocated along the printing line and the printing paper is advanced in a stepped manner, one step per vertical column of dots. As the hammer bank is reciprocated, the various electromagnetic coils are energized in such a manner as to cause the printing of dots in position corresponding to desired patterns to be printed, particularly, alphanumeric patterns. The hammer bank is reciprocated back and forth through a total distance corresponding, for instance, to six columns of dots (one character space).

A problem exists in the dot printer thus constructed. Specifically, in the case where more than a certain number of electromagnetic coils 4 are energized at one time, a delay in the release of some of the print hammer is encountered, thereby lowering the quality of printed characters. Such a problem is disclosed in U.S. Pat. No. 4,280,404 to Barrus et al.

Specifically, in the case where both print hammers adjacent a given hammer are simultaneously released and then the given print hammer is released, the release of the given print hammer will be delayed, again lowering the quality of the printed characters. This problem can be solved by increasing the time period for which the electromagnetic coils are energized. However, another problem is then encountered in that control circuitry becomes complicated and the heat generated by the coils becomes excessive.

It is believed that the above-described phenomenon is attributed to the fact that a portion of the magnetic flux which flows in the pole portions 30 in two previously activated hammer units on either side of a given hammer unit strays into the pole portion 30 of the given hammer unit, causing a momentary increase in the magnetic attractive force, and hence delaying the cancellation of the permanent-magnet-generated magnetic field by the energization of the electromagnetic coil 4 associated with the given hammer. It is possible to prevent this delay by extending the period of energization of the associated electromagnetic coil 4, that is, energizing it starting at an earlier time. However, the same problems mentioned above related to the complexity of the control circuitry needed to implement the technique and the generation of heat occur.

SUMMARY OF THE INVENTION

An object of the present invention is thus to eliminate the drawbacks accompanying the prior art printer head described above and to improve the quality of the printed characters.

This and other objects of the present invention are achieved in accordance with the invention by driving at one time print hammers only in the oddnumbered columns or even-numbered hammer positions (columnar positions). This prevents a delay in the release of the print hammers, specifically, a delay in the release of a print hammer at a central position at times when more than a predetermined number of print hammers are driven, and, more specifically, when the two adjacent print hammers are driven.

DESCRIPTION OF THE PREFERRED EMBODIMENT

Figure 1:
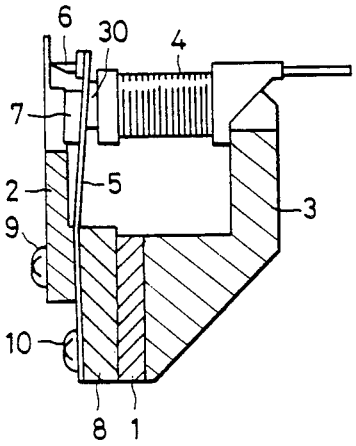
FIG. 1 PRIOR ART
FIG. 1 is a cross-sectional view of a prior art print hammer drive structure.
Figure 2:
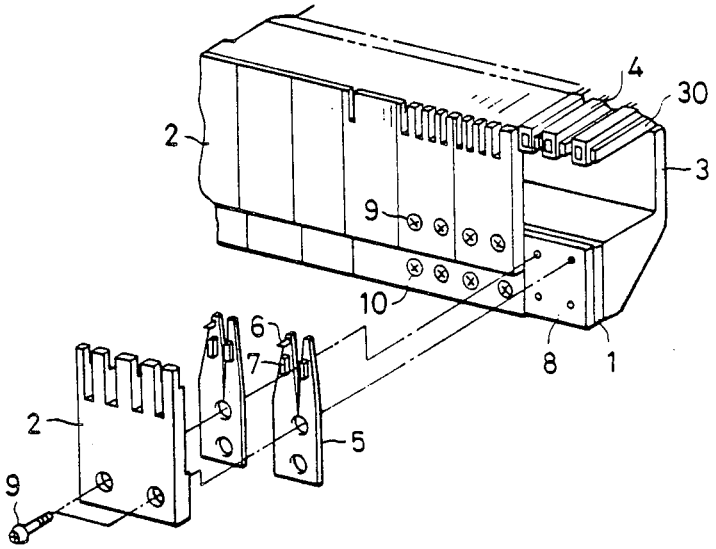
FIG. 2 is an exploded perspective view showing a preferred embodiment of a dot matrix printer head of the present invention.

FIG. 2 illustrates a first preferred embodiment of a printer head constructed in accordance with the present invention. In the first preferred embodiment, electromagnetic coils 4 are disposed around pole portions 30 only in the even-numbered hammer positions, no such coils are provided in the odd-numbered hammer positions. Hammer element leaf springs 5 are provided in all hammer position. However, the leaf springs 5 in the odd-numbered hammer positions are not provided with print pins 6.

With this construction, even if more than the predetermined number of electromagnetic coils 4 are energized, the stray magnetic flux from two adjacent even-numbered hammer positions is absorbed in the "blank" pole portion 30 of the interposed odd-numbered hammer positions, as a result of which there is no "stray" magnetic flux available to interfere with and delay the operation of an active hammer element. Because there is no delay in the release of any print hammer, there is no distortion in the dot patterns of the printed characters.

Further, according to the invention, the pole portions in the odd-numbered hammer positions serve as cooling fins which radiate heat generated by the pole portions in the even-numbered hammer positions. Therefore, the cooling capacity of the printer head is enhanced, thereby making it possible to increase the printing rate.

Although there has been described a case in which only the hammers in the even-numbered positions are driven, it is also possible of course, that only the hammers in the odd-numbered positions are driven. Also, although it has been described that print pins are provided only in the even-numbered hammer positions, it is also possible to provide print pins in all positions. In such a case, half of the print pins simply would not be used.

Although only the hammers in one of the oddnumbered or even-numbered positions are driven to effect printing in the structure thus far described, it is also possible to provide electromagnetic coils and print pins in all positions but to actually operate the coils only in one of the odd-numbered or even-numbered positions. Still further, it is possible to provide electromagnetic coils and print pins in all positions and to effect control in such a way as to alternately drive the hammers in the oddnumbered positions and even-numbered positions. This technique is advantageous in that the life of the print pins is significantly extended. Although the description above refers to a dot matrix printer, it is also possible to apply the invention to a line printer in which print hammers strike against type elements on a type carrier to effect printing.

Thus, in accordance with the present invention, it is not necessary to provide a complicated control circuit, delays in the release of the print hammers are eliminated, and the rate at which heat can be dissipated is increased while still providing an improved print quality.

We claim:

1. A printerhead comprising:

a common yoke;

a plurality of pole pieces extending from said common yoke, said pole pieces being divided into a first group of pole pieces and a second group of pole pieces with the pole pieces in said first group alternating with the pole pieces of said second group;

a permanent magnet coupled to said common yoke at a position opposite said pole pieces, said permanent magnet establishing a magnetic field in each of said pole pieces;

a plurality of print hammers each having a first end rigidly coupled to said common yoke at a position adjacent said permanent magnet and a second end retractable against an end of a corresponding one of said pole pieces due to the magnetic field produced by said permanent magnet; and driving means, comprising a plurality of release coils which are provided only around pole pieces of said first group, for driving only the print hammers corresponding to said first group of pole pieces by at least substantially cancelling the magnetic field in the pole pieces of said first group to accomplish printing of said characters, wherein the magnetic field in each of the pole pieces of said second group is maintained substantially constant during printing of characters except for minor variations due to stray magnetic flux created when said release coils are driven.

2. A printer head comprising:

a common yoke;

a plurality of pole pieces extending from said common yoke parallel to one another;

a permanent magnet coupled to said common yoke at a position opposite said pole pieces;

a plurality of print hammer each having a first end rigidly coupled to said common yoke at a position adjacent said permanent magnet and a second end retractable against an end of a corresponding one of said pole pieces by a magnetic force produced by said permanent magnet; and driving means for driving only alternate ones of said print hammers by at least substantially cancelling the magnetic field in alternate ones of said pole pieces to accomplish printing of characters, said driving means comprising a plurality of release coils, all of said release coils being provided only around alternate ones of said pole pieces, there being no release coils around the other of said release coils.

3. The printer head of claim 2, further comprising a front yoke disposed parallel to said hammer elements between said hammer elements and a recording medium printed upon by said hammer elements.

4. The printer head of claim 3, wherein each of said print hammers comprise a leaf spring and a print pin, said print pin being disposed near said second end of said print hammer.

5. The printer head of claim 4 wherein said leaf spring is elastically deformable.

6. A printer of claim 2 further including print pins provided at said second ends of said print hammers only in positions in which the corresponding print hammer is driven.

7. The printer head of claim 6, further comprising a front yoke disposed parallel to said hammer elements between said hammer elements and a recording medium printed upon by said hammer elements.

* * * * *